US007618117B2

(12) United States Patent
Tanaka et al.

(10) Patent No.: US 7,618,117 B2
(45) Date of Patent: Nov. 17, 2009

(54) PRINTER WITH A FIRST DRIVE SUB-ASSEMBLY AND A DETACHABLE SECOND DRIVE SUB-ASSEMBLY AND PRINTER ASSEMBLY INCLUDING THE FIRST AND SECOND SUB-ASSEMBLIES

(75) Inventors: Hideto Tanaka, Suzaka (JP); Takashi Kiuchi, Nagano (JP); Shigeru Kato, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 405 days.

(21) Appl. No.: 11/472,166

(22) Filed: Jun. 21, 2006

(65) Prior Publication Data

US 2007/0229589 A1 Oct. 4, 2007

(30) Foreign Application Priority Data

Apr. 3, 2006 (JP) ..... 2006-101925

(51) Int. Cl.
*B41J 23/00* (2006.01)

(52) U.S. Cl. ..... 347/37

(58) Field of Classification Search ..... 347/37; 346/29; 384/18; 226/8; 33/1 M; 400/82; 105/141

See application file for complete search history.

(56) References Cited

U.S. PATENT DOCUMENTS 3,333,273 A * 7/1967 Kallen et. al. ..... 346/29
4,131,224 A * 12/1978 Gerber et al. ..... 226/8
4,679,950 A * 7/1987 Delmege et al. ..... 384/18
5,423,617 A * 6/1995 Marsh et al. ..... 400/82
5,493,779 A * 2/1996 Zakrajsek et al. ..... 33/1 M
6,371,032 B1 * 4/2002 Graefer et al. ..... 105/141

FOREIGN PATENT DOCUMENTS

JP 2003-191455 7/2003
JP 2004-148666 5/2004

* cited by examiner

*Primary Examiner*—Stephen D Meier
*Assistant Examiner*—Carlos A Martinez, Jr.
(74) *Attorney, Agent, or Firm*—Ditthavong Mori & Steiner, P.C.

(57) ABSTRACT

A printer includes a first drive sub-assembly and a second drive sub-assembly detachably provided on the first drive sub-assembly. The first drive sub-assembly includes a bed configured to support a material to be printed, a first engaging member, and a front-rear direction moving mechanism provided on one side of the bed and configured to move the first engaging member along a front-rear direction. The second drive sub-assembly includes a guide bar having a longitudinal direction substantially perpendicular to the front-rear direction, a right-left direction moving mechanism configured to move a printer head along the longitudinal direction of the guide bar, and a second engaging member engaging with the first engaging member to move the guide bar along the front-rear direction.

19 Claims, 8 Drawing Sheets

PRINTER WITH A FIRST DRIVE SUB-ASSEMBLY AND A DETACHABLE SECOND DRIVE SUB-ASSEMBLY AND PRINTER ASSEMBLY INCLUDING THE FIRST AND SECOND SUB-ASSEMBLIES

CROSS-REFERENCE TO RELATED APPLICATIONS

The present application claims priority under 35 U.S.C. §119 to Japanese Patent Application No. 2006-101925, filed Apr. 3, 2006, entitled "Printer Apparatus." The contents of this application are incorporated herein by reference in their entirety.

BACKGROUND OF THE INVENTION

1. Field of the Invention

The present invention relates to a printer and a printer assembly.

2. Discussion of the Background

Various types of printers that print characters, figures, etc. on a substrate such as a paper are available. Among them, printers adapted to be connected to a computer are used widely for business or household purpose. A conventional, typical printer prints characters, etc. on a substrate such as a paper or sheet material, while feeding the substrate in a predetermined direction and moving a printer head in a direction perpendicular to that of the substrate. A printer of this type is described in Japanese Unexamined Patent Application Publications 2003-191455 and 2004-148666. The contents of these applications are incorporated herein by reference in their entirety.

On the other hand, substrates, that is, objects to be printed have a various size or shape. In addition, printers tend to be enlarged in order to handle large substrates. As being larger, a printer is more difficult to carry, for example, when the printer is moved from a production line to a user site. It appears that a printer made up of many components as in JP 2003-191455 can overcome this difficulty. However, assembling these components at a user site involves a lot of man-hours. Furthermore, if a printer is of a large type, then its adjustment can be troublesome.

SUMMARY OF THE INVENTION

According to one aspect of the present invention, a printer includes a first drive sub-assembly and a second drive sub-assembly detachably provided on the first drive sub-assembly. The first drive sub-assembly includes a bed, a first engaging member, and a front-rear direction moving mechanism. The bed has a front-rear direction and is configured to support a material to be printed. The front-rear direction moving mechanism is provided on one side of the bed and configured to move the first engaging member along the front-rear direction. The second drive sub-assembly includes a guide bar, a printer head, a right-left direction moving mechanism, and a second engaging member. The guide bar has a longitudinal direction substantially perpendicular to the front-rear direction. The right-left direction moving mechanism is configured to move the printer head along the longitudinal direction of the guide bar. The second engaging member engages with the first engaging member to move the guide bar along the front-rear direction.

According to another aspect of the present invention, a printer assembly includes a first drive sub-assembly and a second drive sub-assembly. The first drive sub-assembly includes a bed, a first engaging member, and a front-rear direction moving mechanism. The bed has a front-rear direction and is configured to support a material to be printed. The front-rear direction moving mechanism is provided on one side of the bed and configured to move the first engaging member along the front-rear direction. The second drive sub-assembly includes a guide bar, a printer head, a right-left direction moving mechanism, and a second engaging member. The guide bar has a longitudinal direction. The right-left direction moving mechanism is configured to move the printer head along the longitudinal direction of the guide bar. The second engaging member is configured to engage with the first engaging member to move the guide bar in the front-rear direction when the second drive sub-assembly is provided on the first drive sub-assembly such that the longitudinal direction of the guide bar is substantially perpendicular to the front-rear direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
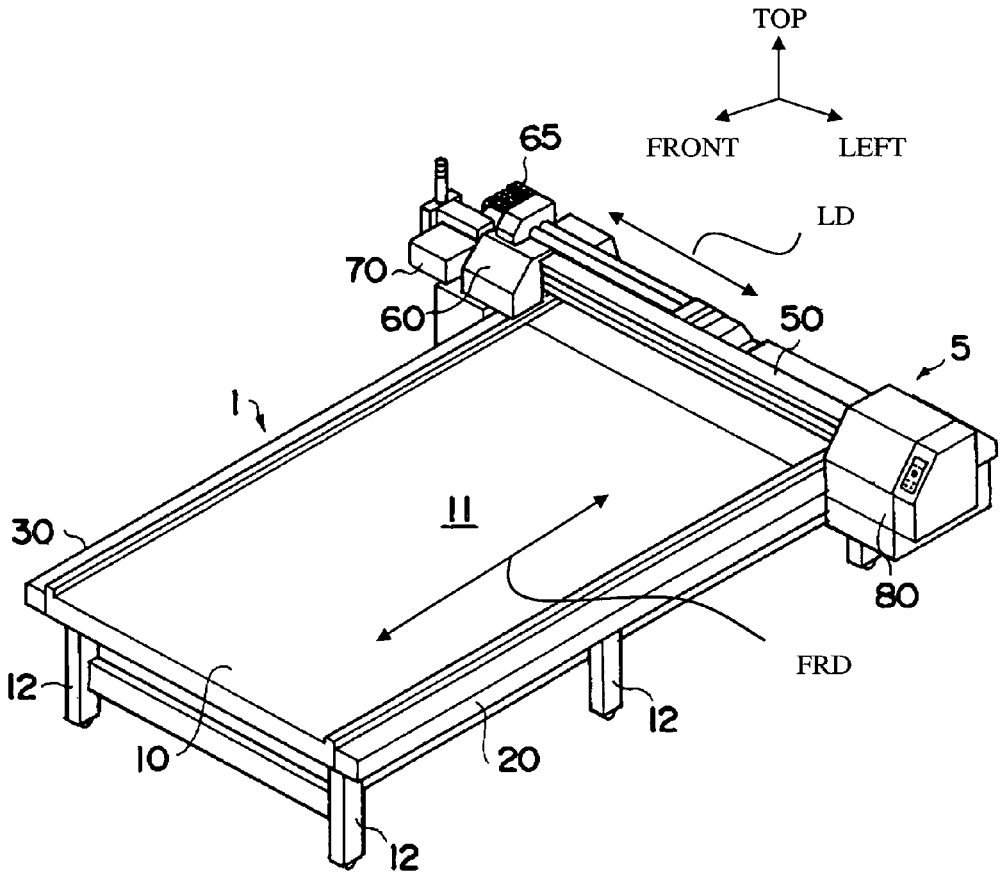
FIG. 1 is a perspective view depicting a printer according to an embodiment of the present invention.

The embodiments will now be described with reference to the accompanying drawings, wherein like reference numerals designate corresponding or identical elements throughout the various drawings. Note that directions in the following description correspond to directions shown in Figures.

Figure 2:
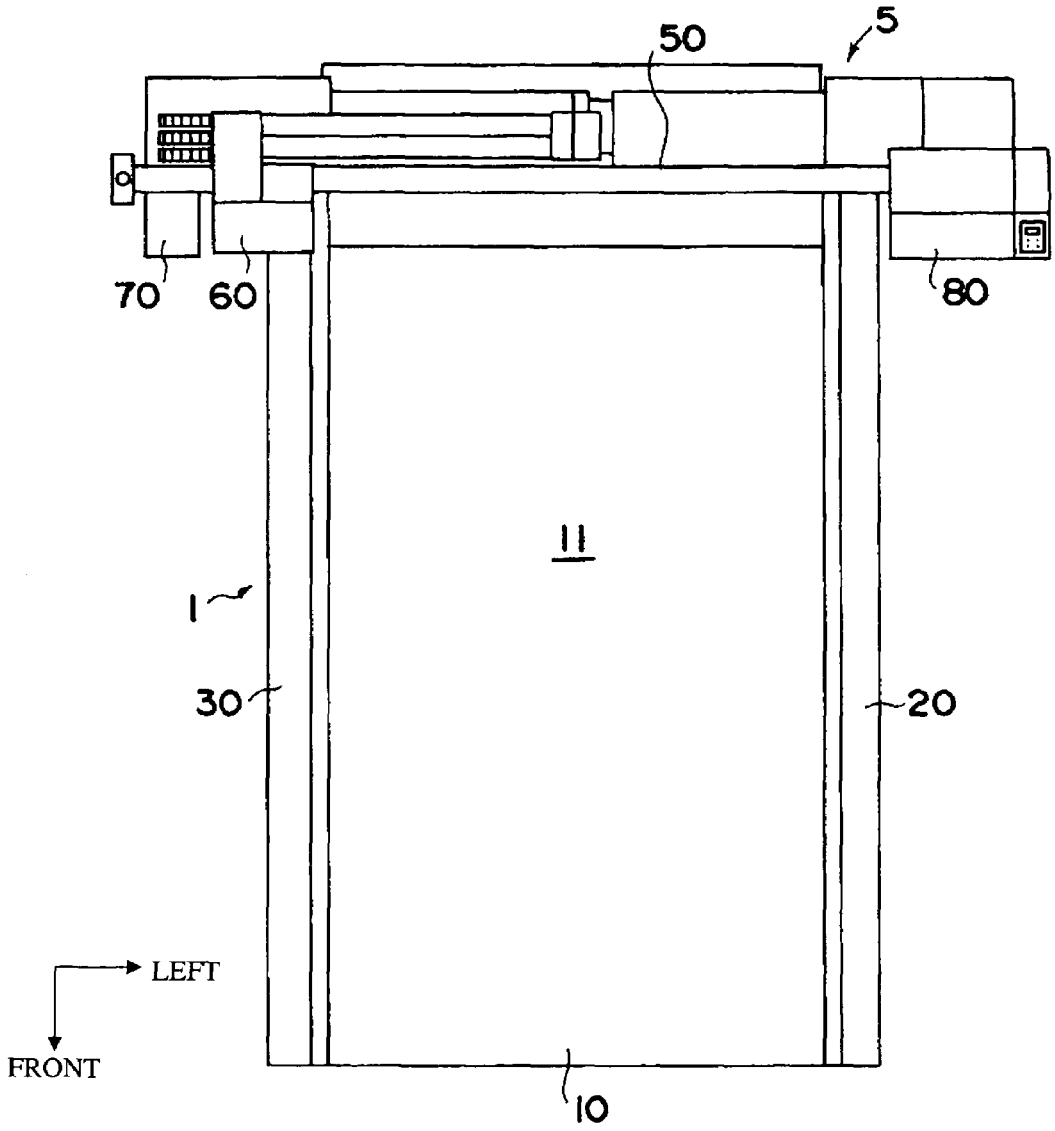
FIG. 2 is a plan view depicting the printer according to the embodiment of the present invention.

Referring to FIGS. 1 and 2, a printer according to an embodiment of the present invention includes a first drive sub-assembly 1 and a second drive sub-assembly 5 as main components. The first drive sub-assembly 1 includes a flat bed 10 on which a sheet shaped substrate is to be set, and front-rear direction moving mechanisms 20 and 30 arranged on the respective long sides of the flat bed 10. The bed 10 has a front-rear direction FRD. The second drive sub-assembly 5 includes a guide bar member 50 extending across the short side of the flat bed 10, an ink supply device 70 and a maintenance station 80 arranged on the respective ends of the guide bar member 50, and a print head 60 moving along a guide bar member 50. The guide bar member 50 has a longitudinal direction LD substantially perpendicular to the front-rear direction FRD. In addition, a power source and a controller 18 are arranged under the flat bed 10 (see FIG. 3).

The flat bed 10 has a large, rectangle-shaped setting-table 11 on which a large, sheet-shaped substrate can be placed. Moreover, the setting table 11 has many holes on its surface, and they suck a substrate by means of negative pressure. This enables the substrate to be secured on the setting table 11. The flat bed 10 has multiple legs 12, and the setting table 11 is set at a desired height from a floor by these legs.

Figure 5:
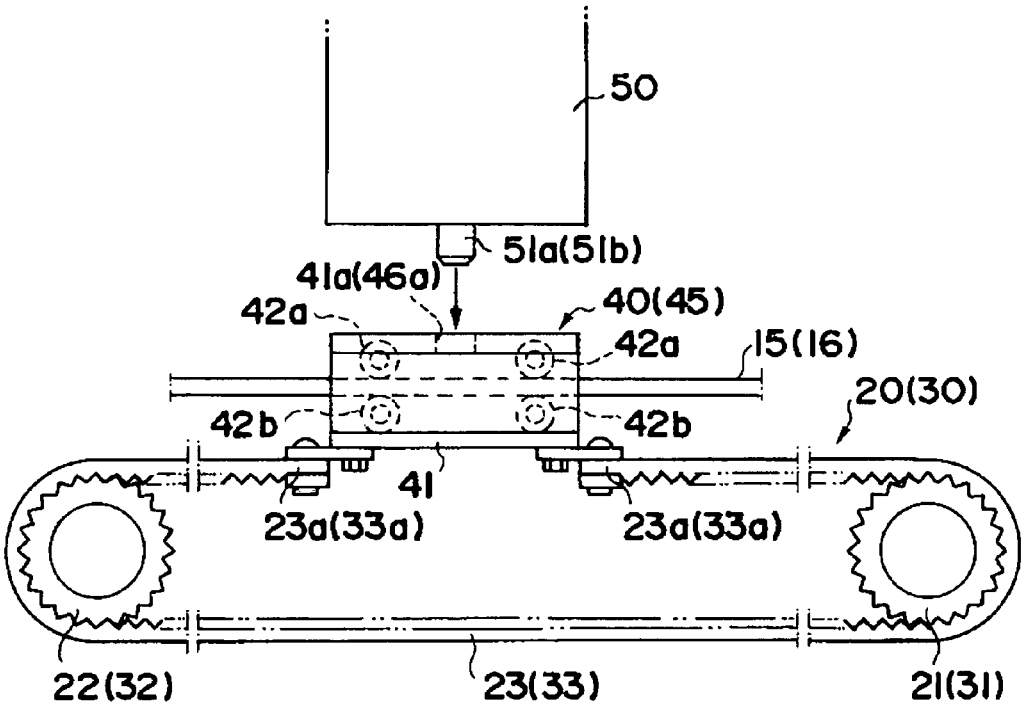
FIG. 5 is a side view depicting a front-rear direction moving mechanism of the printer according to the embodiment of the present invention.
Figure 6:
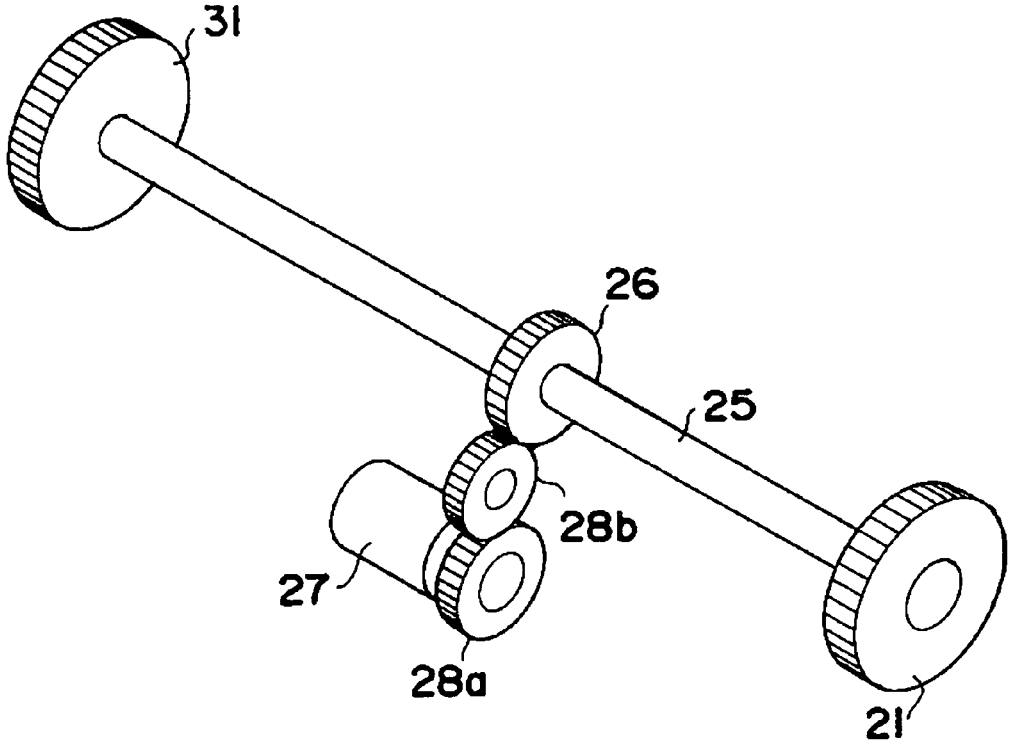
FIG. 6 is a perspective view depicting a driving system of a driving chain wheel in the front-rear direction moving mechanism.

Referring to FIG. 5, the front-rear direction moving mechanism 20 (30), which is placed on the side of the flat bed 10, is constituted of a driving chain wheel 21 (31), a driven chain wheel 22 (32) and a toothed belt 23 (33) strung between both wheels. Both end portions 23*a* (33*a*) and 23*a* (33*a*) of the toothed belt 23 (33) are coupled to each other through a first (second) engaging member 40 (45), so that the toothed belt 23 (33) forms a ring shape. Referring to FIG. 6, the driving chain wheels 21 and 31 are coupled to each other via a driving shaft 25. In the middle of the driving shaft 25, a driving gear 26 is provided. Driving gears 28*a* and 28*b* mate with each other, and the driving gear 28*b* engages with the driving gear 26. The driving gear 28*a* is rotatably driven by the driving motor 27. This motion allows the driving gear 26 to be rotatably driven. Finally, the driving chain wheel 21 and 31 are rotatably driven in sync with each other across the driving shaft 25.

Referring back to FIG. 5, the driving chain wheel 21 (31) and the driven chain wheel 22 (32) are arranged at front and rear portions of the flat bed 10, respectively. The motion of the driving motor 27 allows the toothed belts 23 and 33 to run, thus moving the first and second engaging members 40 and 45 forward or back.

Figure 7:
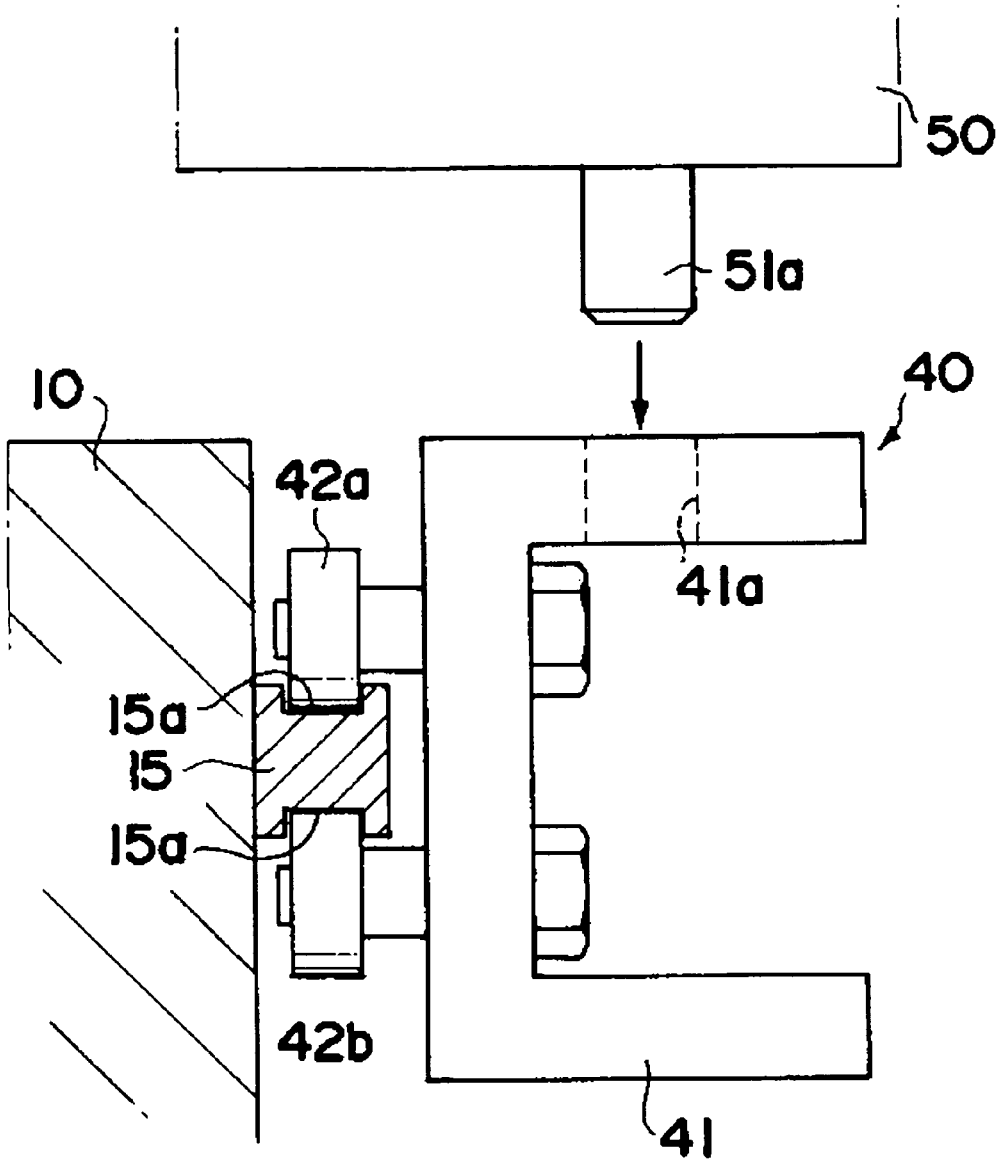
FIG. 7 is a partially cross-sectional view depicting an engaging member of the left front-rear direction moving mechanism and a circumference thereof.

Referring to FIG. 7, the first engaging member 40, which couples both ends of the toothed belt 23 in the left front-rear direction moving mechanism 20, includes a main member 41 having a U-shaped cross section, and guide rollers 42*a* and 42*b*. Both guide rollers are attached to the main member 41, and each couple of rollers are arranged away from each other by a predetermined distance (see FIG. 5). A guide rail 15 is provided on the left side of the flat bed 10. The guide rollers 42*a* and 42*b* mate with guide grooves 15*a* and 15*b* formed on the upper and lower surfaces of the guide rail 15, respectively. The engaging member 40 travels along the guide rail 15. In addition, on the upper portion of the main member 41 of the first engaging member 40, an engaging hole 41*a* is formed.

Figure 8:
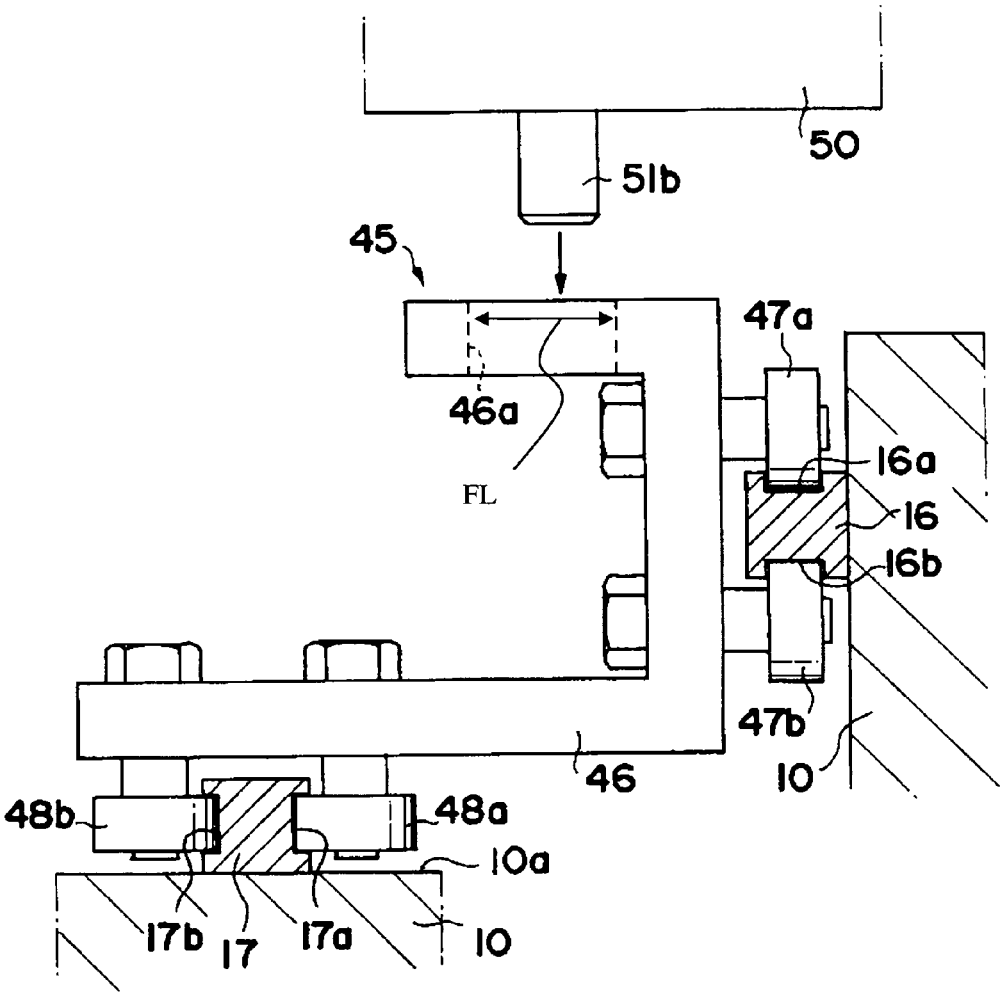
FIG. 8 is a partially cross-sectional view depicting an engaging member of the right front-rear direction moving mechanism and a circumference thereof.

Referring to FIG. 8, the second engaging member 45, which couples both ends of the toothed belt 33 in the right front-rear direction moving mechanism 30, includes a main member 46 having a U-shaped cross section and guide rollers 47*a* and 47*b*. In the main member 46, its lower side is longer than its upper side. The guide rollers 47*a* and 47*b* are attached to the main member 46, and each pair of rollers are arranged away from each other by a predetermined distance. The guide rollers 47*a* and 47*b* are symmetrical to the guide rollers 42*a* and 42*b* of first engaging member 40 of the left front-rear direction moving mechanism 20. Furthermore, a guide rail 16 is attached to the right side of the flat bed 10. The guide rollers 47*a* and 47*b* mate with guide grooves 16*a* and 16*b* of the guide rail 16, respectively. Owing to this arrangement, the second engaging member 45 is movable along the guide rail 16. The upper surface of the main member 46 of the second engaging member 45 has an engaging hole 46*a*.

The lower surface of the main member 46 extends outward, and it has guide rollers 48*a* and 48*b* away from each other by a predetermined distance. On the top side of the flat bed 10, a guide surface 10*a* is provided, and a guide rail 17 is placed on the guide surface 10*a* with extending back and forth. The guide rollers 48*a* and 48*b* mate with the guide grooves 17*a* and 17*b* formed on the left and right sides of the guide rail 17, respectively. The second engaging member 45 is movable along the guide rail 17. Thus, the second engaging member 45 is movable along both the guide rails 16 and 17.

Because of the above arrangement, the rotation of the driving motor 27 (see FIG. 6) allows the toothed belts 23 and 33 to run, thereby traveling the engaging members 40 and 45 (see FIG. 5). In this case, the left engaging member 40 moves precisely along the guide rail 15, while the right engaging member 45 moves precisely along the guide rails 16 and 17.

The second drive sub-assembly 5 is detachably installed on the engaging members 40 and 45 in such a way that the whole second drive sub-assembly 5 is movable. In order to install the second drive sub-assembly 5, the guide bar member 50 has a pair of engaging projections 51*a* and 51*b*. Both projections are arranged away from one another by a predetermined distance, and this distance corresponds to a distance between the engaging members 40 and 45. The engaging projections 51*a* and 51*b* are fitted into the engaging holes 41*a* and 46*a* of the engaging members 40 and 45, respectively. Accordingly, the guide bar member 50 is detachably installed on the engaging members 40 and 45. As a result, while the engaging members 40 and 45 move in sync with each other, the guide bar member 50 travels in conjunction with these members. The engaging projections 51*a* and 51*b* have a cylindrical shape. In addition, any one of the engaging holes 41*a* and 46*a* (for example, the hole 41*a* of FIG. 7) may be a perfect circle, similar to the cross-section of the engaging projection 51*a* or 51*b*. In contrast, the other of the engaging holes 41*a* and 46*a* (for example, the hole 46*a* of FIG. 8) may have a shape similar to the diameter of the engaging projections 51*a* or 51*b* in the back and forth direction, but it may be longer than the engaging projections 51*a* or 51*b* in the lateral direction. In brief, the other of the engaging holes 41*a* and 46*a* may have an elliptical shape. For example, the engaging hole 46*a* has a first length FL in the longitudinal direction LD larger than a second length along the front-rear direction FRD (see FIG. 8). Therefore, even if the diameters of the engaging projections 51*a* and 51*b* differ from each other in the lateral direction, the elliptical engaging hole can accommodate this difference. Consequently, it is easy to install the second drive sub-assembly 5 on the engaging members 40 and 45.

Referring to FIG. 1 again, an ink supply device 70 is provided on the right side of the guide bar member 50, while the maintenance station 80 is provided on the left side. The maintenance station 80 sucks and cleans nozzles of the print head 60 when the print head 60 enters the interior of the maintenance station 80. Moreover, on the right side of the guide bar member 50, a controller that controls the movement of the print head 60 or the output of ink from inkjet nozzles is located in addition to the ink supply device 70.

Figure 3:
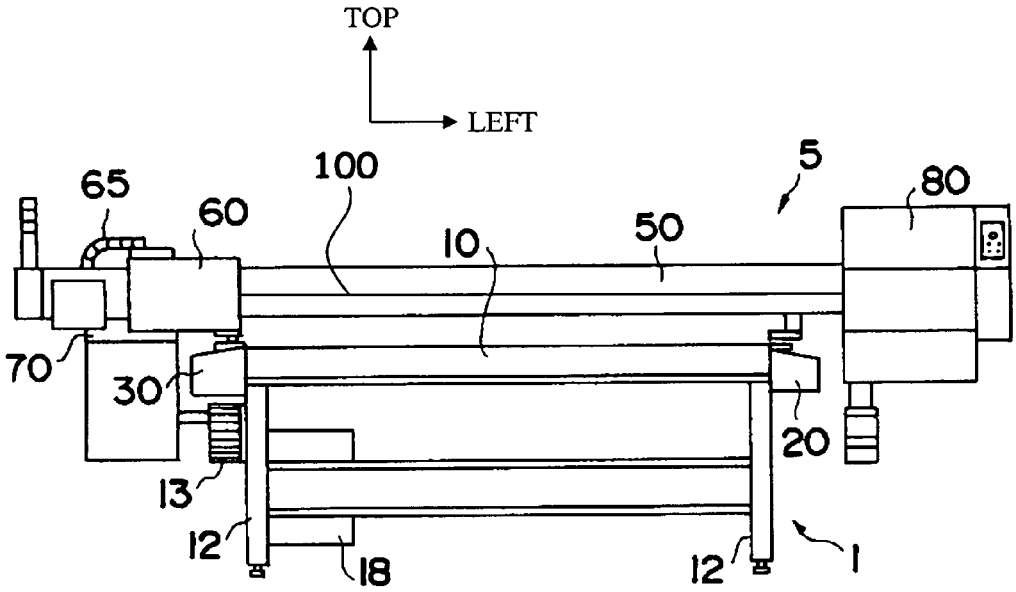
FIG. 3 is a front view depicting the printer according to the embodiment of the present invention.
Figure 4:
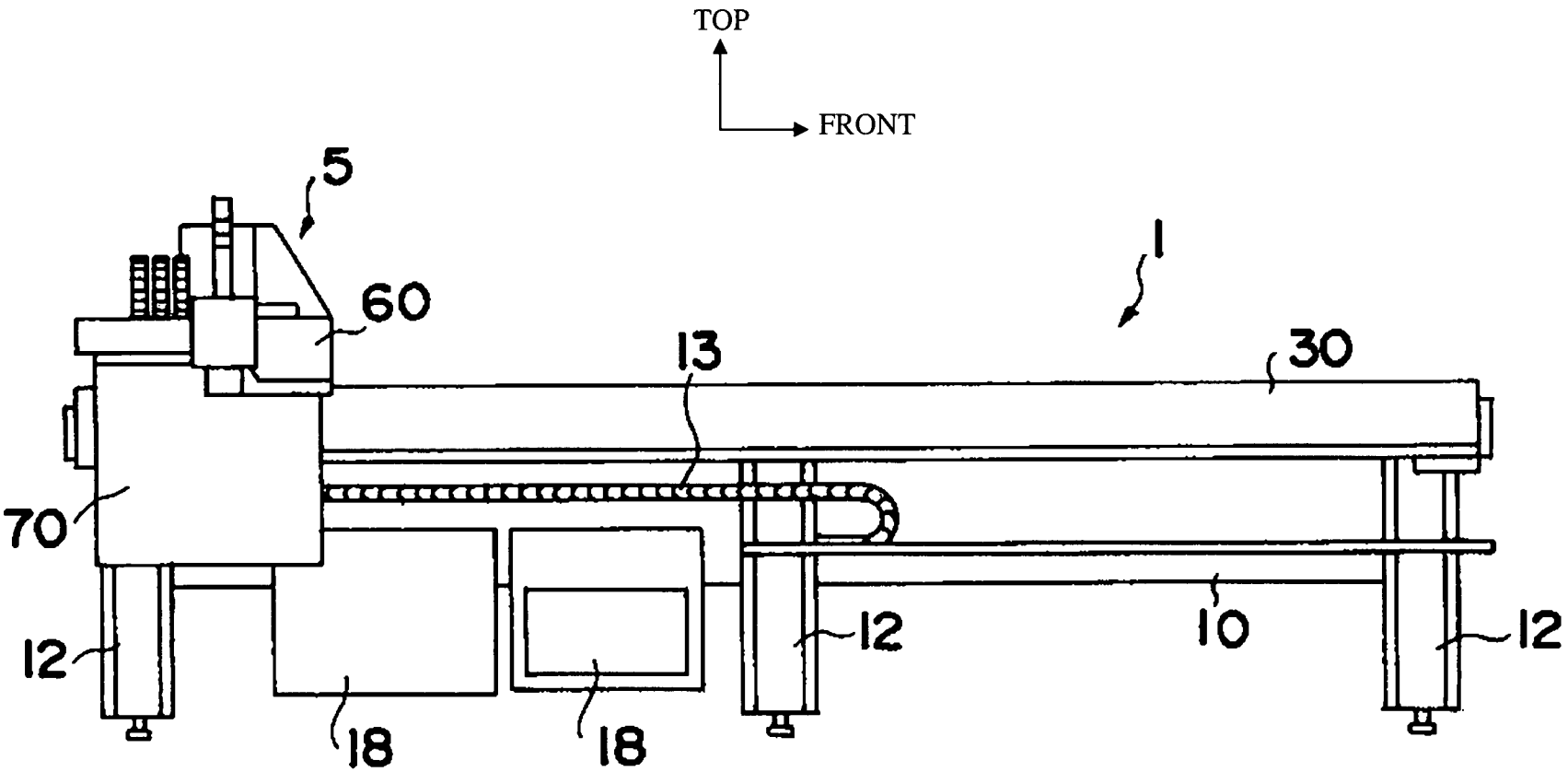
FIG. 4 is a side view depicting the printer according to the embodiment of the present invention.

As shown in FIG. 3, a first flexible cable guide 13, such as the cable bear, which connects the flat bed 10 and the above various devices is provided. The first flexible cable guide 13 may contain a cable connected to a power supply under the flat bed 10 for supplying power, and a cable connecting the controller 18 and the ink supply device 70 or the maintenance station 80 for sending a control signal. With the above arrangement, it is power or a signal can be supplied to the guide bar member 50. In other words, the guide bar member 50 can move back and forth over the flat bed 10.

It is preferable that the guide bar member 50 is equipped with a guide rail (not shown), and that the print head 60 is slidably attached to the guide rail. The guide bar member 50 has right-left direction moving mechanism 100 which is configured to move the printer head 60 along the longitudinal direction LD of the guide bar member 50 (see FIG. 3). On the lower surface of the print head 60, multiple inkjet nozzles (not shown) may be arranged with facing their openings downward. Ink discharged from the nozzles allows desired characters or figures to be printed on a substrate.

A second flexible cable guide 65 connects the guide bar member 50 to the print head 60. This guide 65 may contain cables for supplying power or signals and a flexible tube for supplying ink. With this arrangement, power, a control signal or ink can be supplied from either the guide bar member 50 or the ink supply device 70 to the print head 60. Consequently, it is possible for the print head 60 to travel along the guide bar member 50.

As described above, the printer according to the embodiment of the present invention includes the first drive sub-assembly 1 and the second drive sub-assembly 5. The first drive sub-assembly 1 is constituted of the flat bed 10 and the front-rear direction moving mechanisms 20 and 30 arranged on the respective long sides of the flat bed 10. The second drive sub-assembly 5 is constituted of the guide bar member 50, the ink supply device 70 and the maintenance station 80 that are both arranged on the respective sides of the guide bar member 50, and the print head 60 movably attached to the guide bar member 50. Furthermore, the engaging projections 51*a* and 51*b* of the guide bar member 50 are adapted to be fitted into the engaging holes 41*a* and 46*a* of the engaging members 40 and 45, respectively. Hence, the mechanical coupling of the first and second sub-assemblies can be ensured. Moreover, both assemblies are electrically connected to one another by the flexible cable guide 13 containing cables for supplying power or a control signal.

Merely by detaching the engaging projections 51*a* and 51*b* from the engaging holes 41*a* and 46*a* and by disconnecting the flexible cable guide 13 from both assemblies, the first drive sub-assembly 1 and the second drive sub-assembly 5 can be separated from each other. In addition, both separated assemblies can be carried independently.

Furthermore, when the first drive sub-assembly 1 and the second drive sub-assembly 5 are integrated at a user site, the engaging projections 51*a* and 51*b* are just fitted into the engaging holes 41*a* and 46*a*, respectively, as well as the flexible cable guide 13 is simply connected to both assemblies. In this way, the printer according to the embodiment of the present invention can be set up.

Moreover, the first drive sub-assembly 1 has a long, narrow shape as a whole, while the second drive sub-assembly 5 has a wide, thin shape. Due to the fact that both assemblies are significantly different in shape, each of them can be packed and carried easily.

Although the printer includes two front-rear direction moving mechanisms 20 and 30 in the above embodiment, the printer may include only one front-rear direction moving mechanism.

Although the first and second engaging members 40 and 45 have an engaging hole, respectively, and the guide bar 50 includes engaging projections 51*a* and 51*b*, respectively in the above embodiment, the first and second engaging members 40 and 45 may have engaging projections, and the guide bar 50 includes engaging holes.

Although the engaging hole has a round shape and the engaging projection has a cylindrical shape in the above embodiment, the shapes of the engaging hole and the engaging projection may be any shape.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A printer comprising:

a first drive sub-assembly comprising:

a bed having a first guide rail and a second guide rail extending in a front-rear direction thereof and configured to support a material to be printed;

a first engaging member including a main member having a first pair of guide rollers configured to pivot about axes extending in a right-left direction perpendicular to the front-rear direction and a second pair of guide rollers configured to pivot about axes extending in a vertical direction that is substantially perpendicular to the right-left direction and the front-rear direction, said first pair of guide rollers mating with said first guide rail, and said second pair of guide rollers receiving therebetween and mating with said second guide rail; and a front-rear direction moving mechanism provided on one side of the bed and configured to move the first engaging member along the front-rear direction; and a second drive sub-assembly detachably provided on the first drive sub-assembly and comprising:

a guide bar having a longitudinal direction substantially perpendicular to the front-rear direction;

a printer head;

a right-left direction moving mechanism configured to move the printer head along the longitudinal direction of the guide bar; and a second engaging member engaging with the first engaging member to move the guide bar along the front-rear direction, wherein one of the first engaging member and the second engaging member includes an engaging projection and the other of the first engaging member and the second engaging member includes an engaging hole that is configured to receive the engaging projection therein when the second engaging member is engaged to the first engaging member, and wherein the engaging projection extends in the vertical direction.

2. The printer according to claim 1, wherein the first drive sub-assembly further comprises:

a third engaging member; and an additional front-rear direction moving mechanism provided on another side opposite to said one side of the bed and configured to move the third engaging member in the front-rear direction in synchronization with a movement of the first engaging member; and wherein the second drive sub-assembly further comprises:

a fourth engaging member configured to engage with the third engaging member to move the guide bar in the front-rear direction.

3. The printer according to claim 2, wherein the first engaging member and the third engaging member have a first engaging hole and a second engaging hole, respectively, and the second engaging member and the fourth engaging member have a first engaging projection and a second engaging projection which are inserted into the first engaging hole and the second engaging hole, respectively.

4. The printer according to claim 3, wherein the first engaging hole has a round shape, and wherein the first engaging projection and the second engaging projection have a cylindrical shape.

5. The printer according to claim 4, wherein the first engaging hole and the first engaging projection are so dimensioned such that the first engaging projection fits into the first engaging hole, and wherein the second engaging hole has a first length in the longitudinal direction larger than a second length along the front-rear direction.

6. The printer according to claim 2, wherein:

one of the third engaging member and the fourth engaging member includes an additional engaging projection and the other of the third engaging member and the fourth engaging member includes an additional engaging hole that receives the additional engaging projection therein when the fourth engaging member is engaged to the third engaging member; and the additional engaging projection extends in the vertical direction substantially perpendicular to the longitudinal direction and the front-rear direction.

7. The printer according to claim 6, wherein the engaging hole is circular and the additional engaging hole is elliptical.

8. The printer according to claim 1, wherein the engaging hole has a round shape and the engaging projection has a cylindrical shape.

9. The printer according to claim 1, wherein the fight-left direction moving mechanism is completely provided in the second drive sub-assembly.

10. A printer assembly comprising:

a first drive sub-assembly comprising:

a bed having a first guide rail and a second guide rail extending in a front-rear direction thereof and configured to support a material to be printed;

a first engaging member including a main member having a first pair of guide rollers configured to pivot about axes extending in a fight-left direction perpendicular to the front-rear direction and a second pair of guide rollers configured to pivot about axes extending in a vertical direction that is substantially perpendicular to the right-left direction and the front-rear direction, said first pair of guide rollers mating with said first guide rail, and said second pair of guide rollers receiving therebetween and mating with said second guide rail; and a front-rear direction moving mechanism provided on one side of the bed and configured to move the first engaging member along the front-rear direction; and a second drive sub-assembly comprising:

a guide bar having a longitudinal direction;

a printer head;

a right-left direction moving mechanism configured to move the printer head along the longitudinal direction of the guide bar; and a second engaging member configured to engage with the first engaging member to move the guide bar in the front-rear direction when the second drive sub-assembly is provided on the first drive sub-assembly such that the longitudinal direction of the guide bar is substantially perpendicular to the front-rear direction, wherein one of the first engaging member and the second engaging member includes an engaging projection and the other of the first engaging member and the second engaging member includes an engaging hole that is configured to receive the engaging projection therein when the second engaging member is engaged to the first engaging member, and wherein the engaging projection extends in the vertical direction.

11. The printer assembly according to claim 10, wherein the first drive sub-assembly further comprises:

a third engaging member; and an additional front-rear direction moving mechanism provided on another side opposite to said one side of the bed and configured to move the third engaging member in the front-rear direction in synchronization with a movement of the first engaging member; and wherein the second drive sub-assembly further comprises:

a fourth engaging member configured to engage with the third engaging member to move the guide bar in the front-rear direction.

12. The printer assembly according to claim 11, wherein:

one of the third engaging member and the fourth engaging member includes an additional engaging projection and the other of the third engaging member and the fourth engaging member includes an additional engaging hole that receives the additional engaging projection therein when the fourth engaging member is engaged to the third engaging member; and the additional engaging projection extends in the vertical direction substantially perpendicular to the longitudinal direction and the front-rear direction.

13. The printer assembly according to claim 12, wherein the engaging hole is circular and the additional engaging hole is elliptical.

14. The printer assembly according to claim 10, wherein the fight-left direction moving mechanism is completely provided in the second drive sub-assembly.

15. A printer assembly comprising:

a first drive sub-assembly comprising:

supporting means for supporting a material to be printed, said supporting means including a first guide rail and a second guide rail extending in a front-rear direction thereof;

a first engaging member including a main member having a first pair of guide rollers configured to pivot about axes extending in a right-left direction perpendicular to the front-rear direction and a second pair of guide rollers configured to pivot about axes extending in a vertical direction that is substantially perpendicular to the fight-left direction and the front-rear direction, said first pair of guide rollers mating with said first guide rail, and said second pair of guide rollers receiving therebetween and mating with said second guide rail; and front-rear direction moving means for moving the first engaging member along the front-rear direction of the support means; and a second drive sub-assembly comprising:

a guide bar having a longitudinal direction;

a printer head;

right-left direction moving means for moving the printer head along the longitudinal direction of the guide bar; and a second engaging member configured to engage with the first engaging member to move the guide bar in the front-rear direction when the second drive sub-assembly is provided on the first drive sub-assembly such that the longitudinal direction of the guide bar is substantially perpendicular to the front-rear direction, wherein one of the first engaging member and the second engaging member includes an engaging projection and the other of the first engaging member and the second engaging member includes an engaging hole that is configured to receive the engaging projection therein when the second engaging member is engaged to the first engaging member, and wherein the engaging projection extends in the vertical direction.

16. The printer assembly according to claim 15, wherein the first drive sub-assembly further comprises:

a third engaging member; and an additional front-rear direction moving means provided opposite to the front-rear direction moving means and configured to move the third engaging member in the front-rear direction in synchronization with a movement of the first engaging member; and wherein the second drive sub-assembly further comprises:

a fourth engaging member configured to engage with the third engaging member to move the guide bar in the front-rear direction.

17. The printer assembly according to claim 16, wherein:

one of the third engaging member and the fourth engaging member includes an additional engaging projection and the other of the third engaging member and the fourth engaging member includes an additional engaging hole that receives the additional engaging projection therein when the fourth engaging member is engaged to the third engaging member; and the additional engaging projection extends in the vertical direction substantially perpendicular to the longitudinal direction and the front-rear direction.

18. The printer assembly according to claim 17, wherein the engaging hole is circular and the additional engaging hole is elliptical.

19. The printer assembly according to claim 15, wherein the fight-left direction moving means is completely provided in the second drive sub-assembly.

* * * * *